US012342913B2

(12) United States Patent
Flatley

(10) Patent No.: US 12,342,913 B2
(45) Date of Patent: Jul. 1, 2025

(54) REMOVABLE PROTECTIVE WATCH COVER

(71) Applicant: Moving Bodies Forward L.L.C., Jersey City, NJ (US)

(72) Inventor: Michael Brendan Flatley, Jersey City, NJ (US)

(73) Assignee: Moving Bodies Forward L.L.C., Jersey City, NJ (US)

( * ) Notice: Subject to any disclaimer, the term of this patent is extended or adjusted under 35 U.S.C. 154(b) by 0 days.

(21) Appl. No.: 17/775,653

(22) PCT Filed: Jan. 6, 2022

(86) PCT No.: PCT/US2022/011366

§ 371 (c)(1),
(2) Date: May 10, 2022

(87) PCT Pub. No.: WO2022/150425

PCT Pub. Date: Jul. 14, 2022

(65) Prior Publication Data

US 2023/0354975 A1 Nov. 9, 2023

Related U.S. Application Data

(60) Provisional application No. 63/134,773, filed on Jan. 7, 2021.

(51) Int. Cl.
*A45C 11/00* (2006.01)
*A45C 11/12* (2006.01)

(52) U.S. Cl.
CPC ..... *A45C 11/12* (2013.01); *A45C 2200/10* (2013.01)

(58) Field of Classification Search
CPC ..... A45C 11/12; A45C 2200/10; A45C 11/10; A45C 3/001; A44C 5/0053; A44C 5/00; G04B 37/005
(Continued)

(56) References Cited

U.S. PATENT DOCUMENTS 2,584,270 A * 2/1952 Hucknall ..... G04B 37/005 968/300
4,155,219 A 5/1979 Anderson
(Continued)

FOREIGN PATENT DOCUMENTS

GB 105694 4/1917

OTHER PUBLICATIONS

International Search Report and Written Opinion, dated Feb. 25, 2022, in connection with PCT/US2022/011366, filed Jan. 6, 2022.

*Primary Examiner* — Steven A. Reynolds
(74) *Attorney, Agent, or Firm* — Lippes Mathias LLP

(57) ABSTRACT

A removable protective smart watch cover that includes protective flap portion covering the hard surfaces of an associated smart watch. A smart watch user can slip or otherwise position the removable protective smart watch cover over their smart watch to allow smart watch use during contact sports or during regular exercise. In some embodiments, the construction of the removable protective smart watch cover complies with the standard level of protection required to be worn over hard surfaces during regulated contact sports games to allow smart watch wearers to monitor their activity levels during periods of exercise and activity that otherwise would not be allowed.

7 Claims, 6 Drawing Sheets

(58) Field of Classification Search
USPC ..... 206/6.1; 224/164, 170; 386/281; 368/281, 291, 283, 286; 968/300
See application file for complete search history.

(56) References Cited

U.S. PATENT DOCUMENTS

| | | | | |
|---|---|---|---|---|
| 5,332,135 | A * | 7/1994 | Fletcher | G04B 37/005 224/171 |
| 6,799,887 | B1 | 10/2004 | Kinney | |
| 7,175,340 | B1 | 2/2007 | Kinney | |
| 10,602,820 | B2 * | 3/2020 | Phipps | A45C 11/10 |
| 2016/0250782 | A1 * | 9/2016 | Krass | B29C 43/184 428/76 |
| 2020/0379409 | A1 | 12/2020 | Erlank | |

* cited by examiner

REMOVABLE PROTECTIVE WATCH COVER

CROSS REFERENCE TO RELATED PATENTS AND APPLICATIONS

This application claims priority to and the benefit of the filing date of U.S. Provisional Patent Application Ser. No. 63/134,773, filed Jan. 7, 2021, which application is hereby incorporated by reference.

BACKGROUND

Smart watches have become a very useful health tracking tool for individuals who are looking to monitor their exercise and movement activity. The metrics on the watches have improved dramatically since inception, and now offer advanced heart monitoring and active and resting energy information to its users. Smart watches have begun replacing standard wristwatches, and approximately 80% of smart watch consumers attribute its health monitoring and tracking features as the main reason for purchasing a smart watch.

BRIEF DESCRIPTION

While the popularity of smart watches has increased and the metrics of the applications on smart watches have improved, these smart watches are not currently allowed to be worn during active/contact sports, a period in which users would like to have metrics on their heart monitoring and activity levels, especially if the user has any preexisting heart conditions or if a hereditary heart condition runs in their family genetics.

While there are rugged, hard shelled smart watch protectors in the marketplace, these hard covers only generally focus on preventing potential damage to the watch and may cause harm if worn during a physical game or contact sport. Currently, smart watch wearers are often required to remove their smart watch before playing in contact sports and, thus, they are not tracking their exercise levels. Essentially, the purpose of buying a smart watch—to track exercise and health information—is generally unavailable to athletes at all levels since they are not generally allowed to wear their smart watches during crucial periods of exercise during their games/competitions.

Embodiments in accordance with the present disclosure offer protection to not only the smart watch, as certain embodiments include a clear Thermoplastic polyurethane (TPU) cover over the smart watch face, but also comply with certain rules and regulations of various sport associations such that the smart watch can be worn during practice and/or competitions. In this regard, one embodiment of the present disclosure is a removable protective smart watch cover that includes a soft, mesh-foam flap portion covering the hard surfaces of the smart watch. A smart watch user can slip or otherwise position the removable protective smart watch cover over their smart watch to allow smart watch use during contact sports or during regular exercise. In some embodiments, the construction of the removable protective smart watch cover complies with the standard level of protection required to be worn over hard surfaces during regulated contact sports games. Accordingly, aspects of the present disclosure allow smart watch wearers to monitor their activity levels during periods of exercise and activity that otherwise would not be allowed.

In accordance with one aspect, a removable protective watch cover includes a tubular body portion having a window for viewing a face of an associated watch when positioned on a body of a user, and a flap portion selectively securable to the tubular body portion in closed position covering the window. The flap portion includes cushioning material configured to overlay at least the window of the tubular body portion when the flap portion is in the closed position.

The cushioning material can include a silicone material that is part of a cushion portion of the flap portion. A first end of the flap portion can be fixed to the tubular body portion and a second end of the flap portion can be releasably securable to the tubular body portion such that the flap portion can be moved between the closed position and an open position exposing the window. The window can include a transparent material for protection of the associated watch. At least one of the tubular body portion and flap portion can have elastic properties. The cushioning material further can include first and second layers of mesh sandwiching the silicone material.

The cover can include a strip of material having a first portion having the window and first and second cooperating hook/loop fasteners on opposite sides of the window such that the first portion can be transformed from a substantially planar structure to the tubular body portion by engaging the first and second cooperating hook/loop fasteners. A flap hook/loop fastener can be provided at an end of the strip opposite the first hook and loop fastener and a cushion portion interposed between the flap hook/loop fastener such that the flap hook/loop fastener can be engaged with the second hook/loop fastener with the cushion portion positioned over the window. The cushioning material can include a silicone material. The flap portion can include first and second layers of mesh sandwiching the silicone material.

In accordance with another aspect, a removable protective watch cover system comprises a tubular body portion having a window for viewing a face of an associated watch when positioned on a body of a user, and a flap portion selectively securable to the tubular body portion in closed position covering the window. The flap portion includes a cushion portion configured to overlay at least the window of the tubular body portion when the flap portion is selectively secured to the tubular body portion in the closed position, the flap portion has a length at least as long as the circumference of the tubular body portion such that the flap portion can be worn independently of the tubular body portion with the cushion portion configured to overlay the associated watch.

The window can include a transparent material for protection of the associated watch. At least one of the tubular body portion and flap portion can have elastic properties. The cushion portion can include first and second layers of mesh sandwiching the silicone material.

In accordance with another aspect, a method of covering a watch during use comprises positioning a tubular body portion of a cover over the watch on a wrist of a user, the tubular body portion having a window for viewing a face of the watch, and covering at least a portion of the window with a flap portion of the cover, the flap portion being selectively securable to the tubular body portion in closed position covering the window and including a cushioning material configured to overlay at least a portion of the window of the tubular body portion when the flap portion is in the closed position.

The method can further include moving the flap portion to an open position to expose the watch face, and/or, wrapping a strip of material around the wrist of the user and securing the strip of material in a tubular configuration, and/or selecting one of a plurality of flap portions and removably securing the selected flap portion to the tubular body portion.

DETAILED DESCRIPTION

Figure 1:
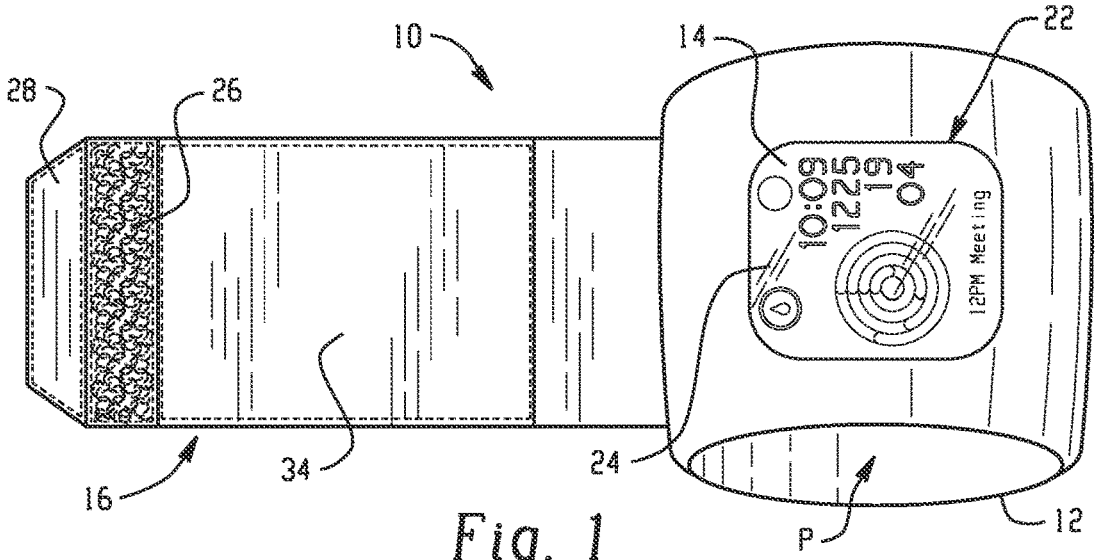
FIG. 1 is a top view of an exemplary cover in accordance with the present disclosure with a flap portion in an open position.

With reference to FIGS. 1-4, an exemplary removable protective smart watch cover is illustrated and identified generally by reference numeral 10. The cover 10 generally includes a tubular body portion 12 having a central passageway P allowing the cover 10 to be slipped over a smart watch 14 being worn by a user, and a flap portion 16 secured at a first end to the tubular body 12 cover by stitching, hook and loop fasteners, or other mechanisms. In other embodiments, the tubular body 12 and the flap portion 16 can be of a unitary, one-piece construction such that stitching or otherwise securing the first end of the flap portion 16 may not be necessary. In still other embodiments, the flap portion 16 may be separable from the tubular body 12.

Figure 2:
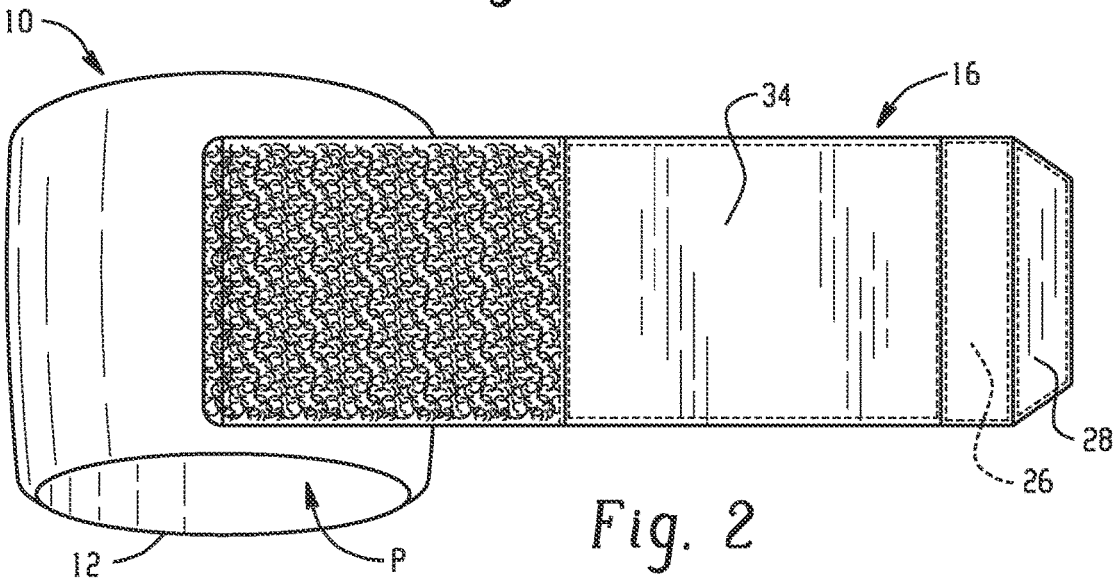
FIG. 2 is a bottom view of the cover of FIG. 1.
Figure 3:
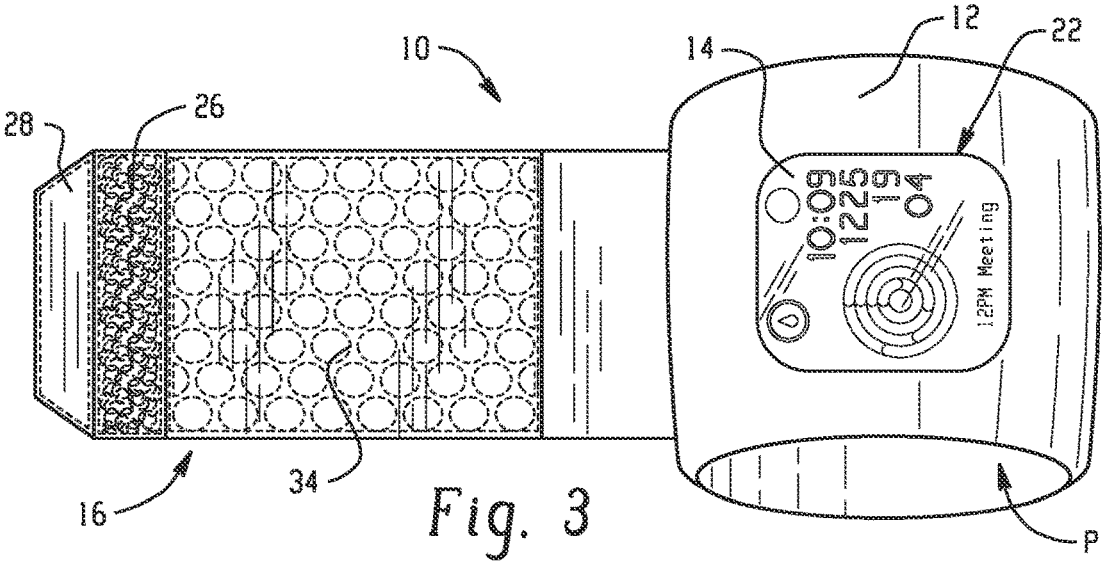
FIG. 3 is a top view similar to FIG. 1 with a portion thereon removed to show internal features of the cover.

In FIGS. 1-3, the cover 10 is shown with the flap portion 16 in an open position revealing the smart watch 14 for viewing and/or use. The tubular body 12 has a window 22 through which the smart watch 14 can be viewed when the flap portion 16 is in the open position. The window 22 can simply be an opening in the tubular body 12. In other embodiments, the window 22 can include a clear plastic 24 or other type of transparent material to protect the surface of the smart watch 14, while still allowing a user to view and/or manipulate the touch surfaces of the smart watch 14.

Figure 4:
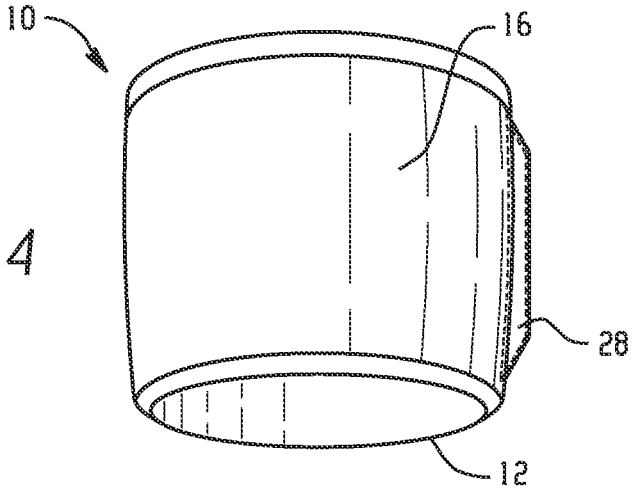
FIG. 4 is a top view of the cover of FIG. 1 with the flap portion in a closed position.

The tubular body 12 and/or flap portion 16 include portions thereof containing a releasable securement mechanism that allows the flap portion 16 to be releasably secured in a closed (protective) position covering the smart watch 14, as shown in FIG. 4. In the closed position the flap portion 16 covers the smart watch 14. In the illustrated embodiment, the cover 10 utilizes a hook and loop type releasable securement mechanism. In this regard, the flap portion 16 includes a hook/loop material 26 that extends generally across the width of the flap portion 16 and is configured to cooperate with a hook/loop material of the tubular body 12 to retain the flap portion 16 in the closed position. In other embodiments, different releasable securement mechanisms can be used such as snaps, clips, magnets, or any other suitable mechanism. A distal end of the flap portion 16 includes a tab portion 28 that allows a user to easily grasp the flap portion 16 when moving the flap portion 16 between the open position and the closed position.

The flap portion 16 further includes a cushion portion 34 configured to overlay the smart watch 14 when the flap portion 16 is in the closed position. The cushion portion 34 include, for example, a silicone material sandwiched between spacer layers of foam/fabric (see FIG. 16) and sewn or otherwise secured to the flap portion 16. In other embodiments, the cushion portion 34 can include a foam or the like. In still other embodiments, the cushion portion 34 can be in the form of an air cushion. Certain configurations of the padding member 34 may be designed to comply with any rules or regulations of one or more sport associations such that the cover 10 allows the smart watch 14 to be worn during practice and/or competition.

Figure 5:
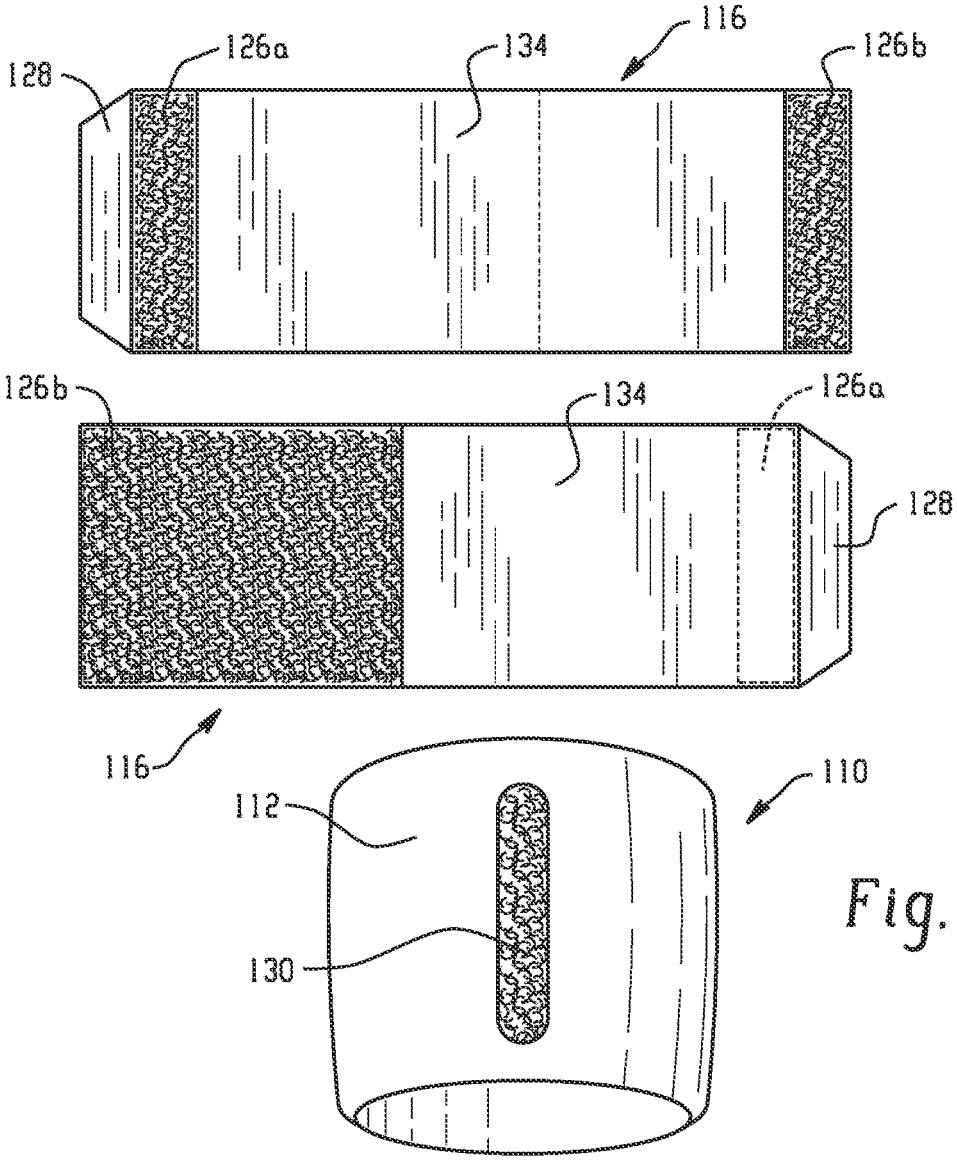
FIG. 5 is a top view of another exemplary removable protective watch cover system in accordance with the present disclosure.

Turning to FIG. 5, another exemplary embodiment of the present disclosure is illustrated and identified generally by reference numeral 110. The cover 110 includes a tubular body portion 112 configured to be slipped over a smart watch 114 worn by a user, and a flap portion 116 removably securable to the tubular body 12 cover by hook and loop fasteners, or other mechanisms. In this embodiment, the cover 110 generally includes the same components as the cover 10 of FIGS. 1-4 with the exception that the flap portion 116 is entirely removable from the tubular body 112. To this end, the tubular body 112 and flap portion 116 have two sets of cooperating hook and loop type fasteners. Although not shown in FIG. 5, the tubular body 112 has a window through which a smart watch can be viewed when the flap portion 116 is in the open position, or separated from the body 112, while the flap portion 116 includes a cushion portion 134 similar to the cover 10 of FIGS. 1-4.

The cover 110 in FIG. 5 is shown with interchangeable flap portions 116 separated from the tubular body 112. The interchangeable flap portions 116 are identical in structure, but can differ in appearance (e.g., color) or other aesthetics. For illustrative purposes, opposite sides of the interchangeable flap portions 116 are shown. A distal end of each flap portion 116 includes a tab portion 128 that allows a user to easily grasp the flap portion 116 when moving the flap portion 116 between the open position and the closed position, or when separating the flap portion 116 from the tubular body 112. Each flap portion 116 includes two strips of hook/loop fasteners **126*a* and 126*b*. Strip 126*a* is similar to strip 34 of the flap portion 16 in the embodiment of FIGS. 1-4. Strip 126*b* is located at an opposite end of the flap portion 116. Strip 126*b* generally secures one end of the flap portion to a cooperating hook/loop fastener 130 of the tubular body portion 112 in a manner and position similar to the stitching or other securing mechanism described above in connection with the embodiment of FIGS. 1-4. Strip 126*a* generally secures the other end of the flap portion 116 to a cooperating hook/loop fastener of the tubular body portion 112 in a manner and position similar to strip 24 embodiment of FIGS. 1-4**.

The embodiment of FIG. 5 advantageously allows a user to swap out different flap portions 116 for a variety of reasons. For example, a flap portion 116 having enhanced cushioning capabilities can be used during certain times, while a different flap portion having perhaps less cushioning capabilities can be used during other times. Interchangeable flap portions 116 of different colors, sizes, materials, etc. can be interchangeably used with the tubular body portion 112. In other examples, a flap portion can simply be replaced when it becomes worn or dirty. In still other embodiments, a portion or all of the flap portion can be comprised of a transparent material that provides certain cushioning and/or protective aspects such that the watch face can be viewed through the flap portion. Such materials can include silicone, or clear plastic air cushions or the like.

In still another example, the flap portion can be used independently as a protective band by securing the flap portion over the smart watch with the cushioning material positioned over the watch face, for example. In this example, the material of the flap portion may cooperate with the flap hook/loop fasteners 126*a* and 126*b* such that the flap portion can be secured about the user's wrist. In this embodiment, the flap portion has a length at least as long as the circumference of the tubular body portion such that the flap portion can be worn independently of the tubular body portion with the cushion portion configured to overlay the associated watch.

Turning to FIGS. 6-9, another exemplary embodiment of a cover in accordance with the present disclosure is illustrated and identified generally by reference numeral 210. In this embodiment, the cover 210 is generally comprised of a strip of material 211 having features thereof that comprise a tubular body portion 212 and a flap portion 216 when worn by a user. To this end, and with reference from left to right in FIG. 6, the strap 211 includes a first hook/loop fastener portion 222 of the tubular body portion 212, a window 226 through which a smart watch can be viewed when the flap portion 216 is in an open position, and a second hook/loop fastener portion 230 of the tubular body portion 212. As in the other embodiments, the window 226 can simply be an opening in the tubular body portion 212. In other embodiments, the window 226 can include a clear plastic or other type of transparent material to protect the surface of a smart watch while still allowing a user to view and/or manipulate the touch surfaces of the smart watch.

Figure 6:
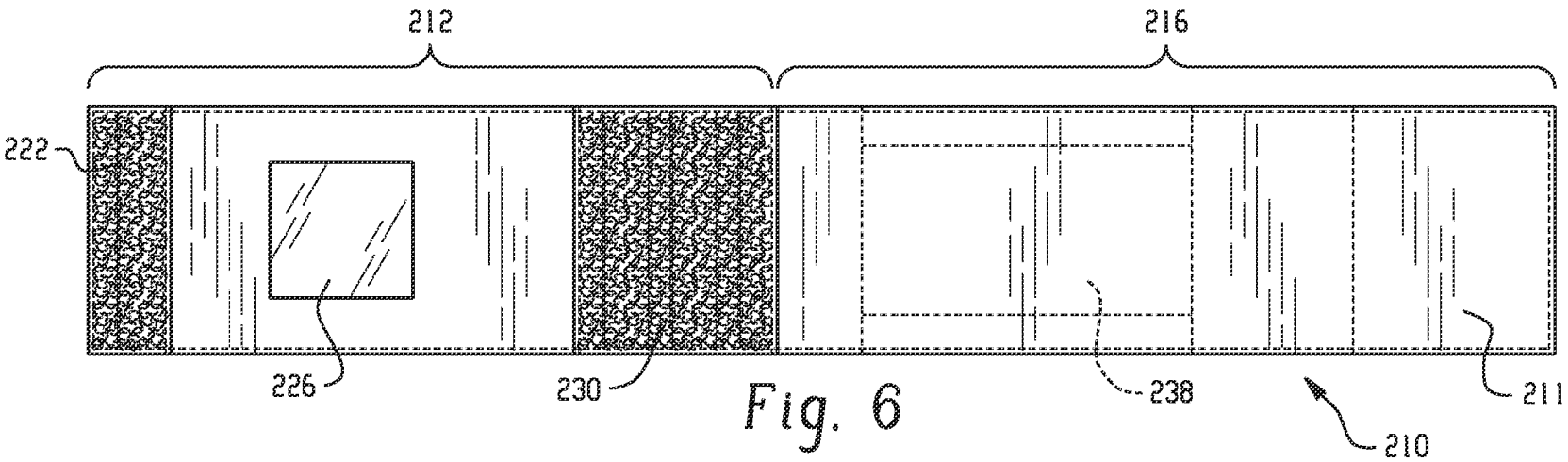
FIG. 6 is a back view of another exemplary cover in accordance with the present disclosure in a substantially planer configuration.
Figure 7:
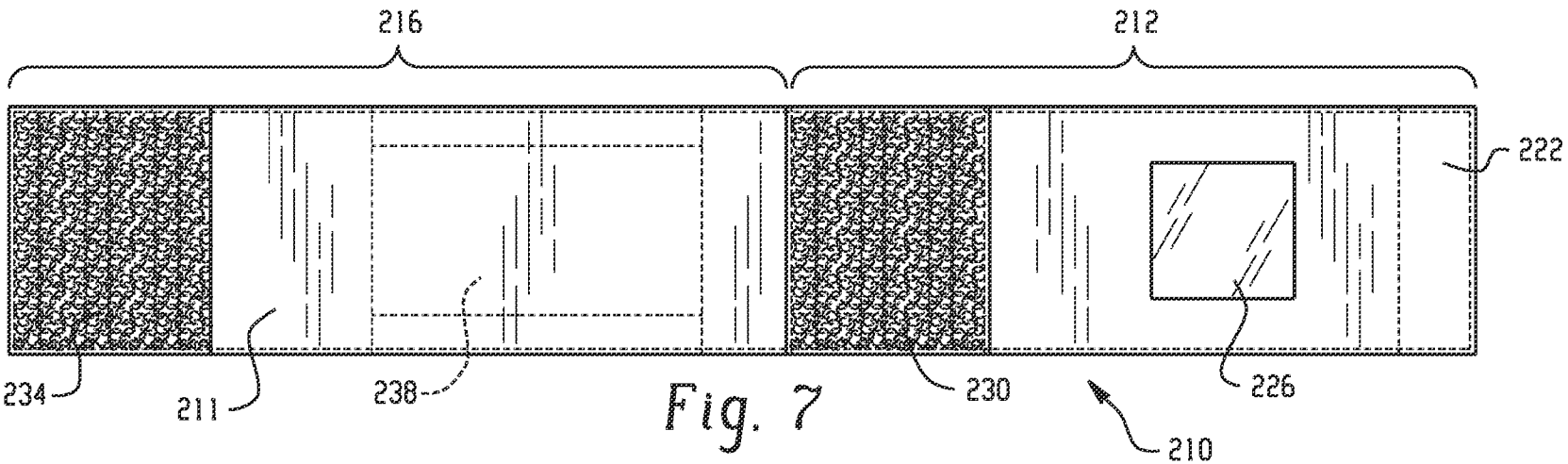
FIG. 7 is a front view of the cover of FIG. 6.

With reference from left to right in FIG. 7, the flap portion 216 includes a flap hook/loop fastener portion 234 and a cushioning portion 238. The flap hook/loop fastener portion is adapted to cooperate with the second hook/look fastener portion 230 of the tubular body portion 212 when the tubular body portion 212 is secured around the wrist of a user. In this regard, it is noted that the second hook/loop fastener portion 230 in this embodiment includes a hook/loop fastener on both the front and back of the strip 211, as shown in FIGS. 6 and 7. Thus, the flap hook/loop fastener portion 234 can engage the second hook/loop fastener portion 230 on the back of the strip 211, while the first hook/loop fastener portion 222 of the tubular body portion 212 can engage the second hook/loop fastener portion 230 on the front of the strap 211.

In use, the tubular body portion 212 of the cover is first wrapped around a wrist of a user such that the first and second hook/loop fasteners 222 and 230 are engaged. In this position, the tubular body portion defines a central passageway 240 through which a user's wrist passes. It should be appreciated that, after initial fitment of the tubular body portion 212, a user may leave the first and second hook/loop fasteners 222 and 230 engaged when removing and/or reinstalling the cover 210. For example, upon initial use the user may adjust the first and second hook/loop fasteners 222 and 230 to achieve a desired fitment of the tubular body portion 212 about the user's wrist. Then, because the strap 211 or portions thereof can be a stretchable or elastic material, the tubular body portion 212 can be slipped off and onto the user's wrist as desired.

Figure 8:
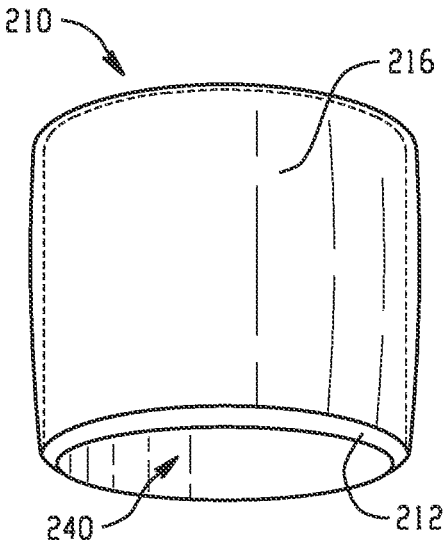
FIG. 8 is a front view of the cover of FIGS. 6 and 7 in a closed configuration.
Figure 9:
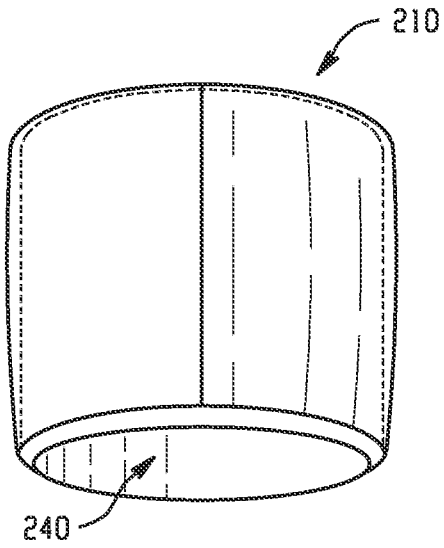
FIG. 9 is a back view of the cover of FIGS. 6 and 7 in a closed configuration.
Figure 10:
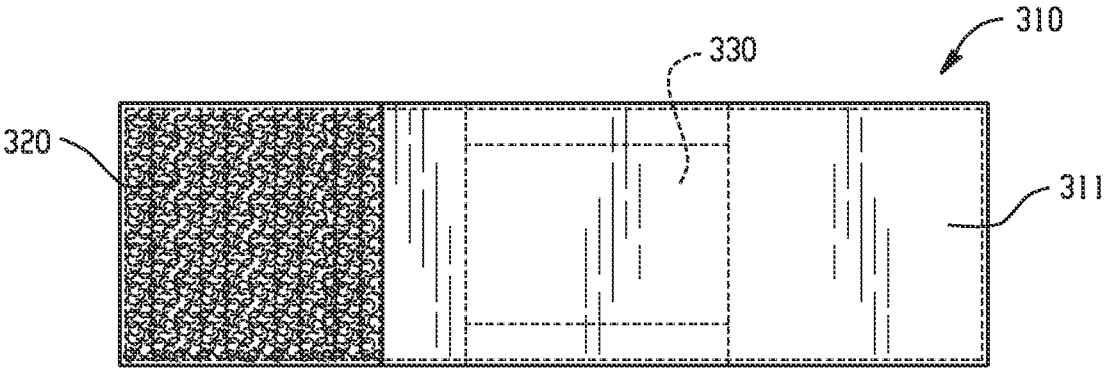
FIG. 10 is a front view of another exemplary removable protective watch cover system in accordance with the present disclosure.
Figure 11:
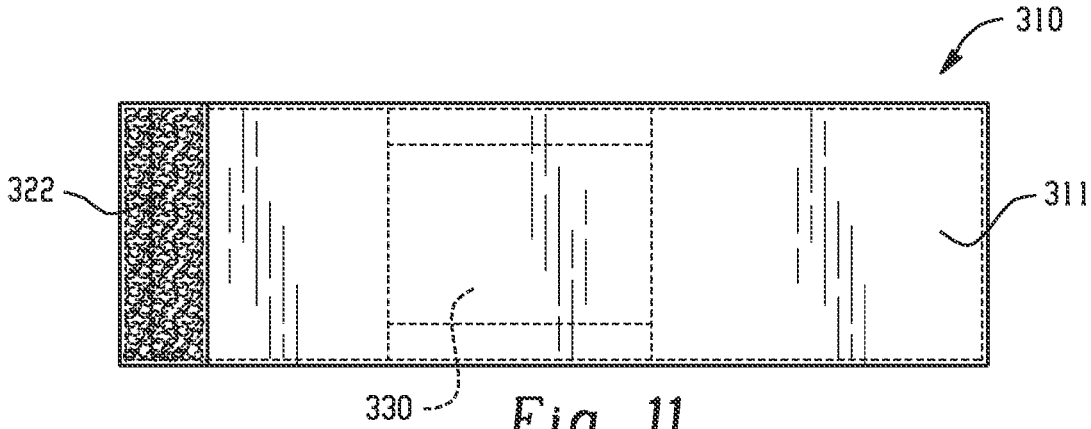
FIG. 11 is a back view of the cover of FIG. 10.
Figure 12:
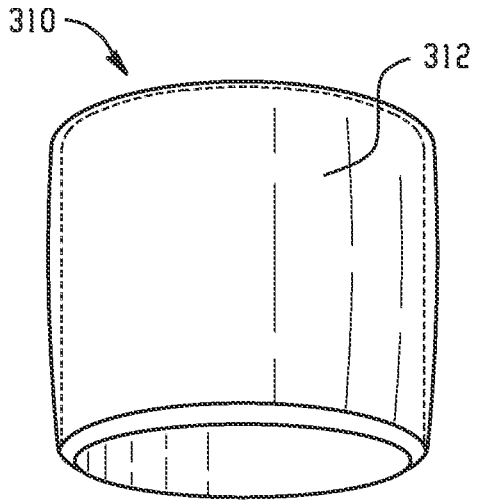
FIG. 12 is a front view of the cover of FIGS. 10 and 11 in a closed configuration.
Figure 13:
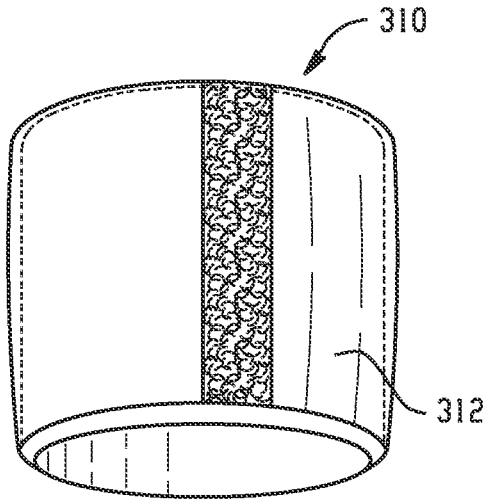
FIG. 13 is a back view of the cover of FIGS. 6 and 7 in a closed configuration.

Once the tubular body portion 212 is configured, the flap portion 216 can be positioned in a closed position by engaging flap hook/look fastener 234 with hook/loop fastener 230. As will be appreciated, this includes wrapping the flap portion 216 around the user's wrist in a manner such that the cushion portion 238 covers the window 226 and/or a bezel or other portions of the smart watch, such as shown in FIGS. 8 and 9. It will further be appreciated that the flap portion 216 can be opened in a manner similar to, for example, the embodiment shown in FIGS. 1-3.

The strip 211 can be comprised of a base layer of material, with the various separate components being attached to the base layer via one or more of stitching, adhesives, or the like. In other examples, the strip 211 can be comprised one or more of the several components joined together in end-to-end fashion to form the strip 211 (e.g., no base layer material).

Further, it should be appreciated that, as used herein, the term tubular body portion refers to both the tubular structure as well as the portion of the substantially planar strip 211 that is transformable into a tubular structure.

Referring now to FIGS. 10-13, another exemplary embodiment of a cover in accordance with the present disclosure is illustrated and identified generally by reference numeral 310. In this embodiment, the cover 310 is generally comprised of a strap of material 311 having features thereof that comprise a tubular body portion 312 when wrapped about a user's wrist, but does not include a window or flap portion as in the above-described embodiments. Accordingly, a cover 310 in accordance with this embodiment may generally be worn by a user when access to a smart watch is not desired or permitted. This may be, for example, during competitive play when access to the smart watch would not be feasible or desired. The strap 311 includes a first hook/loop fastener portion 320 of a front side thereof, a second hook/loop fastener 322 on a back side thereof, and cushion portion 330.

Figure 14:
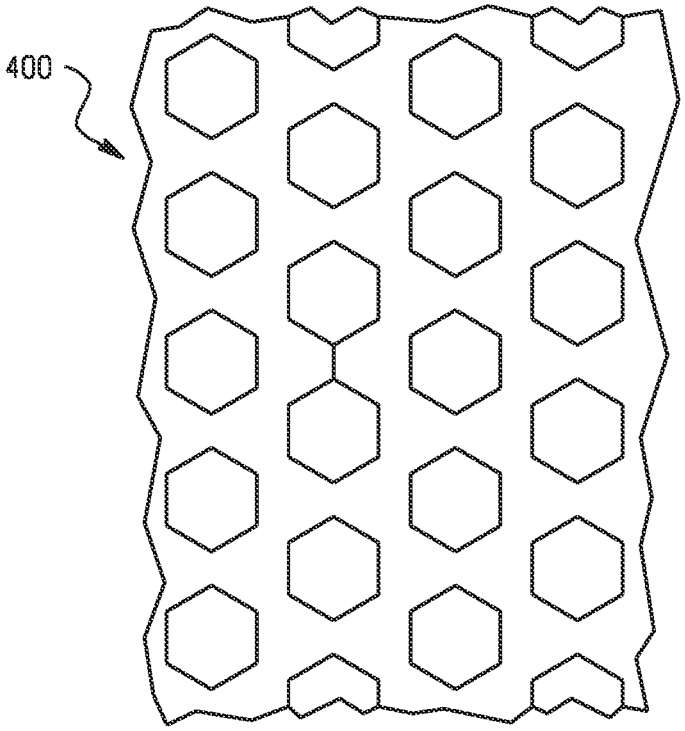
FIG. 14 is a plan view of an example cushioning material.
Figure 15:
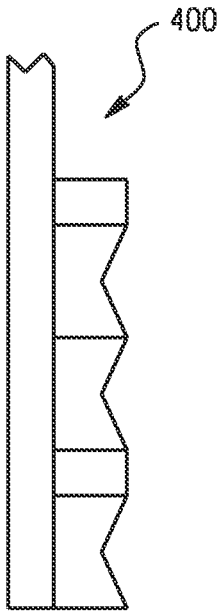
FIG. 15 is a side view of the cushioning material of FIG. 14.

Turning to FIGS. 14 and 15, an exemplary material that can be used for the cushion in the above-described embodiments is illustrated. This material includes a silicone patch 400, which is some embodiments may be a 2 inch×3 inch silicone patch having a thickness of between, for example, ⅜ inch (or less) to ½ inch (or greater). It will be appreciated that a wide range of thickness and sizes of the silicone patch 400 can be used without departing from the scope of the present disclosure.

Figure 16:
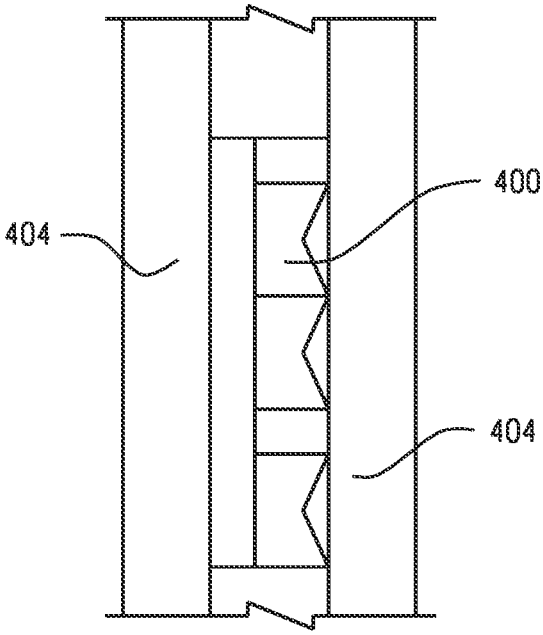
FIG. 16 is a cross-sectional view of an exemplary cushion portion in accordance with the present disclosure.

FIG. 16 illustrates a cushion portion of the exemplary embodiments comprised of the silicone patch 400 sandwiched between layers of spacer mesh 404.

In use, the various embodiments of the present disclosure can be slipped, or other-wise positioned over/around the wrist of a user wearing a smart watch and located such that the window of the tubular body portion is aligned with the smart watch face. The flap portion can be selectively opened and closed by the user to access the smart watch when desired. In general, the flap portion will remain in the closed position unless the user is interacting with the smart watch. Accordingly, the flap portion can be configured with resilient components that tend to automatically return the flap portion to the closed position when released by the user.

Various materials can be used for the different elements of the exemplary embodiments. In some examples, the mesh layers can include a neoprene or other fabric or mesh. Other cushioning materials can include a laminated foam, a molded foam, a covered foam, silicone or the like, or any combination thereof. The cushioning material can be sandwiched between layers of spacer. The tubular body portion of the exemplary embodiments can be a circular knit tube, a quilted material a 3D knit, a sock knit or a thick ponte, for example. Various materials can be used including one or more of cotton, nylon, polyester rubber and/or spandex, for example.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A removable protective watch cover comprising:

a one-piece tubular body portion formed of a single continuous member having a window for viewing a face of an associated watch when positioned on a body of a user, wherein said tubular body portion is configured to enclose said watch; and a flap portion selectively securable to the tubular body portion in a closed position covering the window;

wherein the flap portion includes cushioning material configured to overlay at least the window of the tubular body portion when the flap portion is in the closed position;

wherein the cushioning material includes a silicone material that is part of a cushion portion of the flap portion;

wherein a first end of the flap portion is fixed to the tubular body portion and a second end of the flap portion is releasably securable to the tubular body portion such that the flap portion can be moved between the closed position and an open position exposing the window;

wherein the window includes a transparent material for protection of the associated watch;

wherein at least one of the tubular body portion and flap portion have elastic properties; and, wherein the cushioning material further includes first and second layers of mesh sandwiching the silicone material.

2. A removable protective watch cover comprising:

a one-piece tubular body portion formed of a single continuous member having a window for viewing a face of an associated watch when positioned on a body of a user, wherein said tubular body portion is configured to enclose said watch; and a flap portion selectively securable to the tubular body portion in a closed position covering the window;

wherein the flap portion includes a cushioning portion configured to overlay at least the window of the tubular body portion when the flap portion is in the closed position;

wherein a first end of the flap portion is fixed to the tubular body portion and a second end of the flap portion is releasably securable to the tubular body portion such that the flap portion can be moved between the closed position and an open position exposing the window;

wherein at least one of the tubular body portion and flap portion have elastic properties; and, wherein the cushioning portion further includes first and second layers of a fabric material sandwiching the cushioning portion of the flap portion.

3. The removable protective watch cover of claim 2, wherein the window includes a transparent material for protection of the associated watch.

4. The removable protective watch cover of claim 3, wherein the cushioning portion comprises a silicone material.

5. The removable protective watch cover of claim 4, wherein the first and second layers comprise a mesh fabric material.

6. The removable protective watch cover of claim 3, wherein the cushioning portion comprises a foam material.

7. The removable protective watch cover of claim 3, wherein the cushioning portion comprises an air cushion.

* * * * *